US009847622B2

(12) United States Patent
Akiyoshi et al.

(10) Patent No.: US 9,847,622 B2
(45) Date of Patent: Dec. 19, 2017

(54) SPARK PLUG FOR AN INTERNAL COMBUSTION ENGINE

(71) Applicant: DENSO CORPORATION, Kariya, Aichi-pref. (JP)

(72) Inventors: Ryohei Akiyoshi, Kariya (JP); Hidekazu Fujimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/464,716

(22) Filed: Mar. 21, 2017

(65) Prior Publication Data

US 2017/0279248 A1 Sep. 28, 2017

(30) Foreign Application Priority Data

Mar. 24, 2016 (JP) ..... 2016-060418

(51) Int. Cl.
*H01T 13/20* (2006.01)
*H01T 13/32* (2006.01)

(52) U.S. Cl.
CPC ..... *H01T 13/32* (2013.01)

(58) Field of Classification Search
CPC ..... H01T 13/32
See application file for complete search history.

(56) References Cited

U.S. PATENT DOCUMENTS

2007/0080618 A1 4/2007 Torii et al.
2010/0264803 A1* 10/2010 Nunome ..... H01T 21/02 313/141
2013/0328476 A1* 12/2013 Ban ..... H01T 13/32 313/141
2014/0239797 A1* 8/2014 Ban ..... H01T 13/32 313/141

FOREIGN PATENT DOCUMENTS

JP 8-213149 8/1996
JP 2008-204882 9/2008
JP 2013-114754 6/2013

* cited by examiner

*Primary Examiner* — Donald Raleigh
(74) *Attorney, Agent, or Firm* — Nixon & Vanderhye P.C.

(57) ABSTRACT

A spark plug for an internal combustion engine provided with a cylindrical housing, a ceramic insulator, a center electrode and a ground electrode. The ground electrode has a body base disposed from a front end surface of the cylindrical housing to a front end-side thereof. The ground electrode has a spark discharge gap formed therebetween itself and the center electrode. The body base is provided with pair of side-connecting surfaces which connect the inner surface and the outer surface. Each of the side-connecting surfaces having a side flat surface which is a flat surface parallel to an aligning direction of the center electrode and the body base. A distance between the pair of the side flat surfaces is a maximum width of the body base. A minimum distance between the inner surface and the side flat surface satisfies a relationship of 0.1 mm≤L≤0.5 mm, in the aligning direction.

8 Claims, 6 Drawing Sheets

SPARK PLUG FOR AN INTERNAL COMBUSTION ENGINE

CROSS-REFERENCE TO RELATED APPLICATION

This application is based on and claims the benefit of priority from earlier Japanese Patent Application No. 2016-60418, filed on Mar. 24, 2016 the description of which is incorporated herein by reference.

TECHNICAL FIELD

The present invention relates to a spark plug for an internal combustion engine, and more specifically relates to a spark plug for generating a discharge in a spark discharge gap as an ignition means for an internal combustion engine.

RELATED ART

Among spark plugs used to ignite internal combustion engines, for example, in a vehicle, there is a spark plug configured to have a spark discharge gap formed such that a center electrode and a ground electrode are opposed in the axial direction of the spark plug. In this type of spark plug a discharge is formed at the spark discharge gap, and the discharge ignites an air fuel mixture in a combustion engine.

In the combustion chamber, a flow of the air fuel mixture, for example, a swirl or tumble flow is formed, and the air fuel flows in a moderate fashion around a spark discharge gap, maintaining ignitability.

There is however, a case where a section of a ground electrode, which is a section joined to a front end surface of a housing, being disposed upstream of the spark discharge gap in relation to the flow, depending on a fitted state of the spark plug, for example, a direction of the mounted spark plug in the internal combustion engine. If the part of the ground electrode is positioned upstream as described above, the flow of the air fuel mixture in a combustion chamber is blocked by the ground electrode, and the flow may even be stagnated around the spark discharge gap. In turn, this may cause the ignitability of the spark plug to decrease as a result. In the above configuration, ignitability of the spark plug may vary causing problems, depending on the fitted state, that is, the direction of the spark plug in relation to the flow mounted in the combustion engine.

Furthermore, regarding the fitted state of the spark plug mounted in an internal combustion engine, it is particularly difficult to control the position of the ground electrode in the circumferential direction thereof. This is caused by the fitted state of the spark plug being changed, for example, by a formed state of a mounting screw of the housing, and a fastening degree of the spark plug when being mounted in the combustion engine. If the fitted state of the spark plug is changed, the direction of the ground electrode is also changed in relation to the flow in the combustion chamber. As a result, the direction of the ground electrode may obstruct the flow in the combustion chamber.

In order to prevent obstruction of the flow due to the ground electrode, Patent Literature 1, JPT-B 5337307, discloses a spark plug configured to have both surfaces of an electrode provided in a circumferential direction, to form a specific curved formation dilating in the circumferential direction thereof.

However, as far as suppressing the obstruction of the ground electrode is concerned, it is considered that the spark plug disclosed in the patent literature 1 can be further improved. Particularly in recent years, internal combustion engines for lean combustion have been widely used, however, in such engines a combustion stability can decrease, in relation to the fitted state of the spark plug mounted in the internal combustion engine. More specifically, the combustion stability may decrease, depending on the fitted state of spark plug, for example, depending on the direction of the ground electrode in relation to the flow in the internal combustion engine. As a consequence, there is an increased demand to take appropriate measures to suppress an obstruction of the flow due to the ground electrode.

SUMMARY

In view of the foregoing, the present disclosure aims to provide a spark plug for an internal combustion engine with a secure and stable ignition performance, regardless of a fitted state of the spark plug in relation with a flow in the internal combustion engine.

A mode for the present disclosure in accordance with a preferred embodiment is a spark plug for an internal combustion engine, the spark plug having a cylindrical housing, a cylindrical porcelain insulator disposed at an inner-side of the cylindrical housing, a center electrode disposed at an inner-side of the porcelain insulator so that a front end of the center electrode is projected, and a body base as the body base of a ground electrode. The body base is disposed from a front end portion of the cylindrical housing towards a front end-side. The ground electrode forms a spark discharge gap between itself and the center electrode. The body base is provided with an inner surface opposing a side of the center electrode, an outer surface facing an opposing side of the center electrode and a pair of side-connecting surfaces connecting the inner surface and the outer surface.

The cylindrical housing has a center axis defined as an axial direction, a plane being perpendicular to the axial direction being a plane, an aligning direction and a width direction being defined as mutually orthogonal directions on the plane.

Each of the side-connecting surfaces having a side flat surface which is a flat surface parallel to the aligning direction of the center electrode and the body base. A distance between the pair of side flat surfaces being a maximum width of the body base in a width direction orthogonal to both the plug axial direction and the aligning direction, and a minimum distance between the inner surface and the side flat face which satisfies a relationship of 0.5 mm≤D≤1.0 mm.

According to the spark plug for an internal combustion engine, each of the side-connecting surfaces has the side flat surface which is a flat surface disposed parallel to the aligning direction. The minimum distance between the inner surface and the side flat surface satisfies a relationship of 0.5 mm≤D≤1.0 mm. That is, by maintaining the flat surface, a remaining inner-side surface part can be formed, for example, as a curved surface. If the flat surface is provided, a rectification effect of a viscosity resistance of the flat surface and a fluid flow surface is elicited. Furthermore, in optimizing the minimum distance, a balance between the rectification effect and prevention of vortices occurring can be obtained. The optimization range is can be set as a fixed distance. As a result, obstruction of a flow in the combustion chamber due to the fitted state of the spark plug, mounted in the internal combustion engine is prevented, when the flow is directed to flow to the spark discharge gap. Specifically, even when the body base of the ground electrode is disposed at an upstream-side of the flow, with respect to the spark discharge gap, the flow from the spark discharge gap is maintained.

As the result, a discharged spark is sufficiently drawn out, regardless of the fitted state of the spark plug in an internal combustion engine.

The mode set forth provides a spark plug for an internal combustion engine that maintains a stable ignition performance, regardless of a fitted state in which the spark plug is mounted in the internal combustion engine.

It is noted that the symbols set forth in the specifications and claims are provided to explicitly describe the preferred embodiment and do not limit the technical scope of the invention.

BRIEF DESCRIPTION OF THE DRAWINGS

The following detailed description of the illustrative embodiments can be understood when read in conjunction with the following drawings. In the following drawings.

DETAILED DESCRIPTION OF THE PREFERRED EMBODIMENT

A preferred embodiment will be described with reference to the accompanying drawings.

Figure 1:
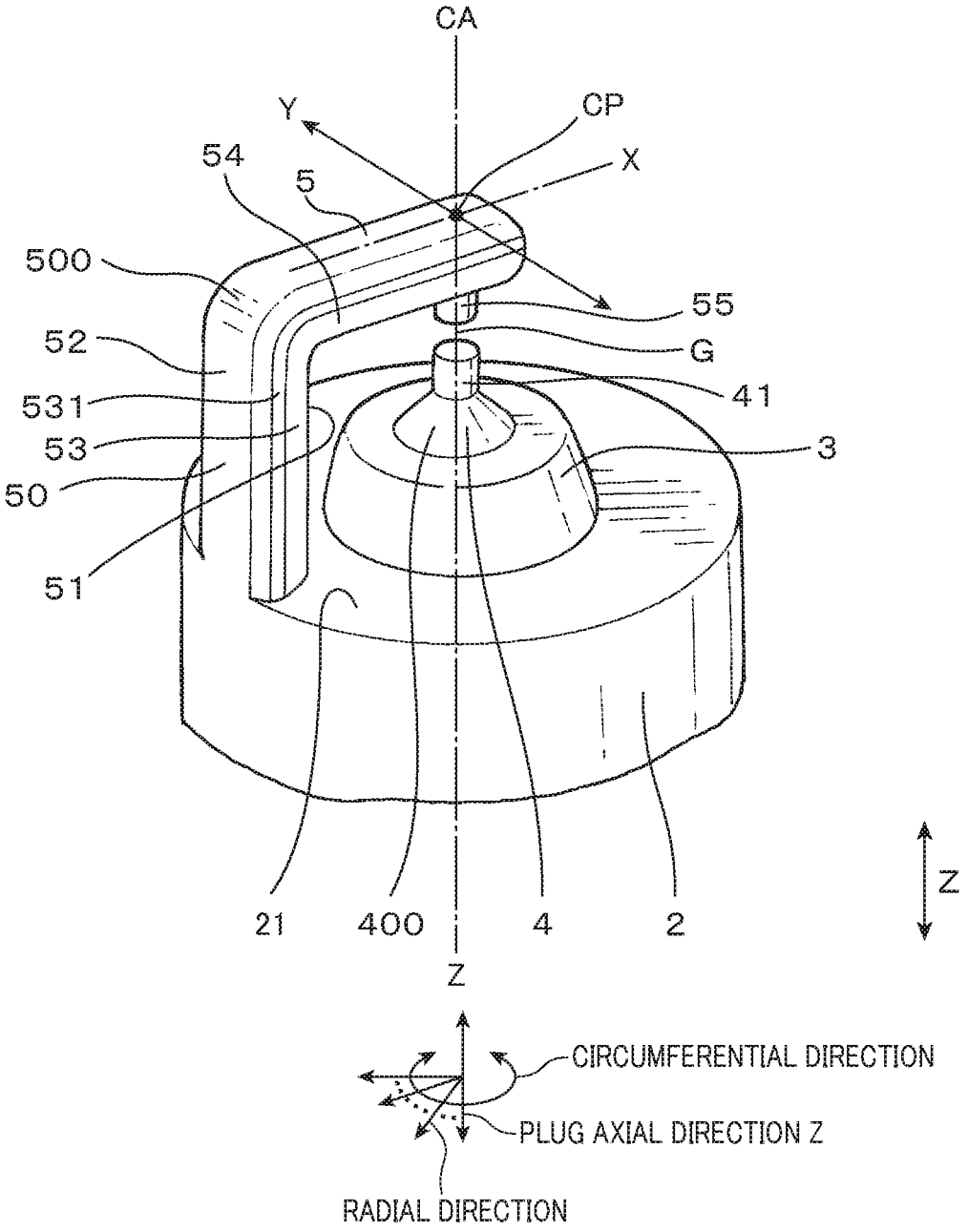
FIG. 1 is a perspective view illustrating a top end section of a spark plug, according to a first embodiment.
Figure 2:
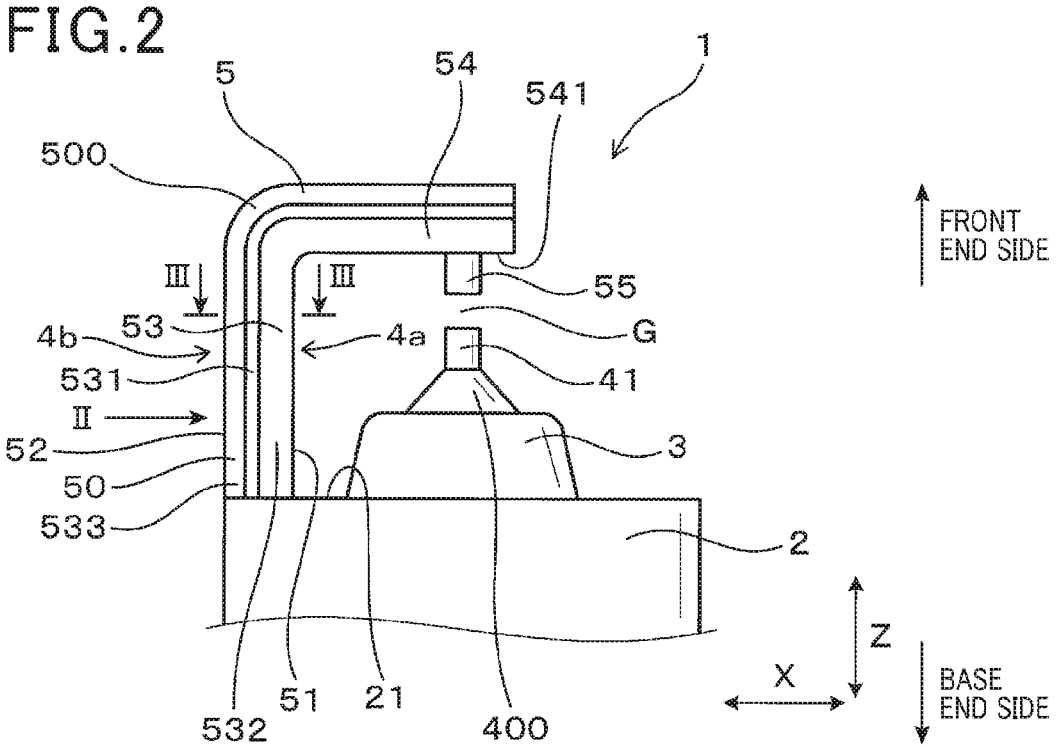
FIG. 2 is a diagram showing a descriptive front view of the spark plug according to the first embodiment.
Figure 3:
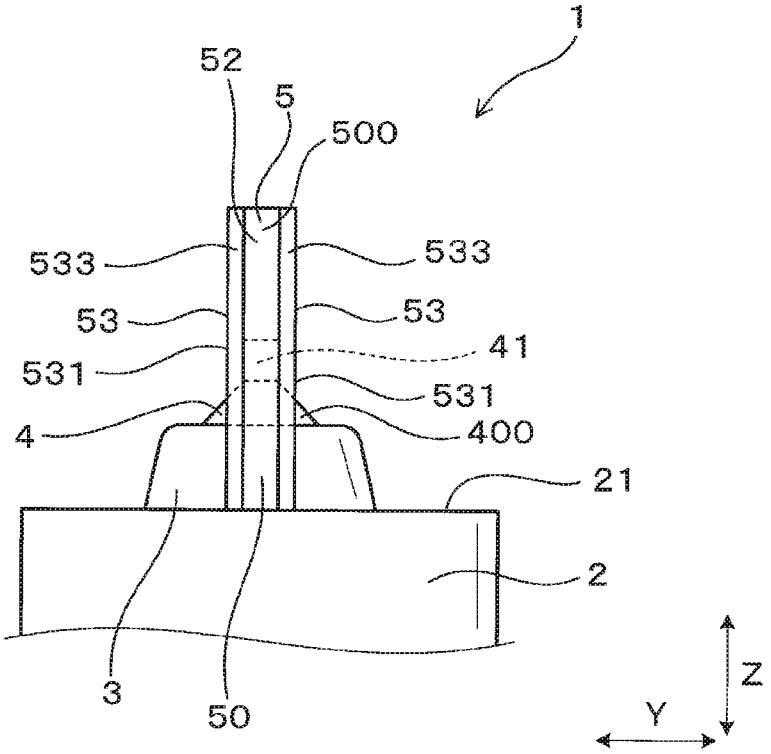
FIG. 3 is a side view of an arrow line II shown in FIG. 2.

With reference to FIG. 1 to FIG. 7, a spark plug 1 for a combustion engine according to the preferred embodiment is described. As shown in FIG. 2 and FIG. 3, the spark plug 1 for an internal combustion according to the preferred embodiment is provided with a housing 2, a ceramic insulator 3, a center electrode 4, and a ground electrode 5. The housing 2 is cylindrically shaped. The ceramic insulator 3 disposed at an inner-side of the housing 2 is also a cylindrically shaped. The cylindrical housing 2 has a center axis CA defined as an axial direction Z, so that a plane being perpendicular to the axial direction Z is defined as an X-Y plane, an aligning direction X and a width direction Y are defined as mutually orthogonal directions on the X-Y plane. The aligning direction X passes a central position CP in the width direction Y.

The center electrode 4 is disposed at an inner-side of the ceramic insulator 3, so that a tip end portion 41 is projected. The ground electrode 5 is provided with a body base 50, which is disposed from a front end portion 21 of the housing 2 to a front end side thereof, in relation to an aligning direction X. The ground electrode 5 forms a spark discharge gap G therebetween itself and the center electrode 4.

Figure 4:
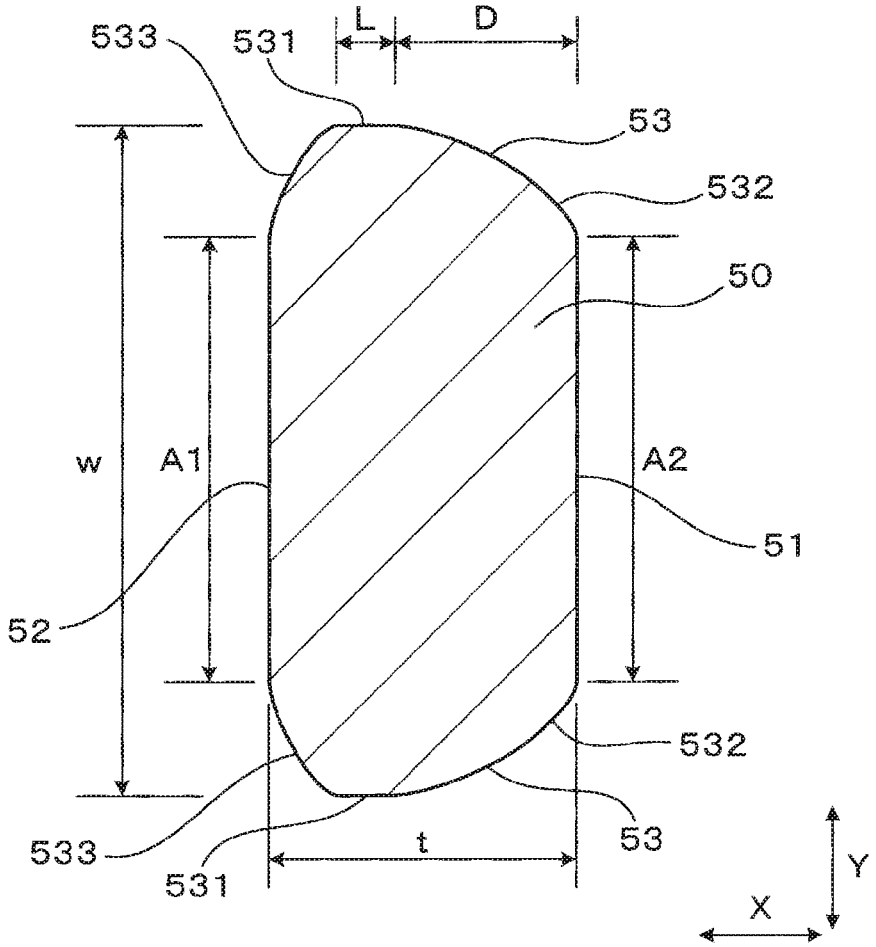
FIG. 4 is a cross sectional diagram of an arrow line III-III shown in FIG. 2.

As shown in FIG. 2 and FIG. 4, the body base 50 is provided with an inner surface 51 opposing a side of a center electrode 4, hereon referred to as a 'side 4*a*', an outer surface 52 facing an opposing side, hereon referred to as a 'side 4*b*', which opposes the side 4*a* of the center electrode 4, and a pair of side-connecting surfaces 53 which join the inner surface 51 and the outer surface 52.

Each of the side-connecting surfaces 53 has a side flat surface 531, which is a flat surface parallel to the center electrode 4 and the body base 50, in the aligning direction X. A distance between the pair of flat surfaces 531, in a width direction Y, that is orthogonal to both a plug axial direction Z and the aligning direction X, being a maximum width w of the body base 50. A minimum distance D between the inner surface 51 and the side flat surface 531 satisfies a relationship of $0.5 \leq D \leq 1.0$ mm, in the aligning direction X.

It is noted that the side of the center electrode is an inner-side of the body base 50 with respect to the center electrode 4. The opposing side of the side of the center electrode is an outer-side of the body base 50.

The front end side Fr is defined as a side of the spark plug 1 that is introduced in a combustion chamber. An opposing side to the front end side of the plug axial aligning direction X is defined as a base end side Bs. The aligning direction X, the width direction Y and the spark plug 1 axial direction Z are orthogonal from each other, as shown in FIG. 2 and FIG. 3. The aligning direction X of the center electrode 4 and body base 50 can also simply be referred to as 'aligning direction X' hereon.

As shown in FIG. 2, the body base 50 of the ground electrode 5 is formed parallel to the plug axial direction Z. FIG. 4 shows that the body base 50 is formed in a substantial rectangular shape, so that both sides of the width direction Y are expanded in the width direction. An outer circumferential surface of the body base 50 is provided with the inner surface 51, the outer surface 52 and the pair of side-connecting surfaces 53. The inner surface 51 and the outer surface 52 are flat surfaces positioned orthogonal to the aligning direction X.

As shown in FIG. 2 and FIG. 4, the pair of side flat surfaces 531 are formed on a section of the side-connecting surface 53, in the aligning direction X. As also shown in FIG. 4, according to the preferred embodiment, the pair of side flat surfaces 531 are cross section formations orthogonal to the plug axial direction Z, which are each disposed parallel in a straight line formation in the aligning direction X. In the preferred embodiment, the pair of side flat surfaces 531 are flat surfaces, parallel to both the aligning direction X and the plug axial direction Z. In other words, the side flat surface 531 is a flat surface formed, so that the width direction Y is in a perpendicular direction. In the preferred embodiment, a length L of the side flat surface 531, satisfies a relationship of $0.1 \text{ mm} \leq L \leq 0.5$ mm, in the aligning direction X. As described above, the width between the pair of side flat surfaces 531 is the maximum width w of the body base 50 in the width direction Y.

As shown in FIG. 2 and FIG. 4, each of the connecting surfaces 53 is provided with the side flat surface 531, an inner-side side-surface 532 and an outer-side side-surface 533. The pair of inner-side side-surfaces 532 are surfaces formed on the side 4*a* of the center electrode 4 of the pair of the side flat surfaces 531 on the pair of connecting surfaces 53. The pair of the inner-side side-surfaces 532 are curved faces, curved smoothly so that the more the inner-side side-surfaces 532 face towards the side 4*a* of center electrode 4 in the aligning direction X, the closer the pair of the inner-side side-surfaces 532 become to each other, as shown in FIG. 4. In other words, the pair of inner-side side-surfaces 532 are formed in a curved shape, smoothly curved so that, the more the cross sectional shape, orthogonal to the plug axial direction Z faces towards the side 4*a* of center electrode 4 in the aligning direction X, the closer the pair of inner-side surfaces 532 become to each other. The pair of the inner-side side-surfaces 532 are smoothly connected to the pair of side flat surfaces 531 and the inner surfaces 51.

In contrast, the pair of outer-side side-surfaces 533 are surfaces formed so that, the more that the outer-side side-surfaces 533 are positioned to face an opposing side 4*b* of the side 4*a* of the center electrode 4 in the aligning direction X, the closer the outer-side-surfaces 533 become to each other. The pair of outer-side side-surfaces 533 are curved faces smoothly curved so that the more they face towards the side 4*b* which opposes the side 4*a* of the center electrode 4 in the aligning direction X, the closer the pair of outer-side surfaces 533 become to each other. In other words, as shown in FIG. 4, the pair outer-side side-surfaces 533 are a curved shape, smoothly curved so that, the more the cross sectional formation orthogonal to the plug axial direction Z, faces the side 4*b* of the center electrode 4, the closer the pair of outer-side-surfaces become to each other. The pair of the outer-side side-surfaces 533 are smoothly joined to the pair of side flat surfaces 531 and the outer surface 52.

As described above, the minimum distance D of the aligning direction X between the inner surface 51 and the side flat surface 531 satisfies a relationship of 0.5 mm≤D≤1.0 mm. The minimum distance D defines a distance from an end portion of the side flat surface 531 to the inner surface 51, in the aligning direction X. The end portion of the side flat surface 531 is positioned on the side 4*a* of the center electrode 4 thereof.

In the preferred embodiment, dimension of the inner-side side-surface 532 is in a range of 0.5 mm to 1 mm, in the aligning direction X. Also in the preferred embodiment, a maximum thickness t of the body base 50 satisfies the following dimensional relationship:

$$t>(L+D),$$

in the aligning direction X.

As shown in FIG. 2, the ground electrode 5 is provided with an opposing section 54, which is disposed from a front end side of the body base 50, to curve towards the side 4*a* of the center electrode 4 in the aligning direction X. The opposing section 54 is formed from the front end side of the body base 50 and extends to an overlapping point of the opposing section 54 and the center electrode 4, in the plug axial direction Z. The ground electrode 5 is formed from the body base 50 and the opposing section 54, by curving a rod shaped metallic material. More specifically, the ground electrode is formed by bending the rod shaped metallic material, which is formed into a rectangular cross sectional shape, orthogonal in a longitudinal direction as shown in FIG. 2. As a result, the cross sectional shape of the opposing section 54 in the longitudinal direction, is a same shape as the cross section shape of the body base 50, orthogonal to the plug axial direction Z.

The ground electrode 5 is provided with a projecting tip portion 55 which projects from a counter surface 541 of the opposing section 54, which faces the side 4*a* of the center electrode 4 of the opposing section 54. The spark discharge gap G is formed between the projecting tip portion 55 and the tip end portion 41 of the center electrode 4. The projecting tip portion 55 is formed by joining a noble metal tip made of a platinum metal alloy, for example, to the counter surface 541. That is, the ground electrode 5 is provided with a ground electrode base member 500 made of a nickel alloy and the projecting tip portion 55 made of the noble metal tip. The noble metal tip is welded to the ground electrode base member 500.

The center electrode 4 is also formed by welding a noble metal, for example, iridium, on a tip end of the center electrode base member 400. That is, a noble metal tip configures the tip end portion 41 of the center electrode 4.

The spark plug 1 in the present embodiment, can be used for an internal combustion engine of a vehicle, for example.

The effect of the preferred embodiment will now be described.

According to the spark plug 1 for an internal combustion engine, each of the side-connecting surfaces 53 are provided with the slide flat surface 531 which is a flat surface parallel to the aligning direction X. The minimum distance D between the inner surface 51 and the side flat surface 531 satisfies a relationship of 0.5 mm≤D≤1.0 mm. That is, by maintaining the flat surface 531, a remaining inner-side surface part can be formed, for example, as a curved surface. By having the flat surface 531 in the configuration, a rectification effect of an increased viscosity resistance of the flat surface 531 and a fluid flow surface is elicited. Furthermore, in optimizing the minimum distance D, a balance between the rectification effect and prevention of vortices occurring can be obtained. The optimization range can be set as a fixed distance. As a result, obstruction of the combustion chamber flow, by a way of mounting the spark plug 1 in the combustion chamber is prevented, when the flow is directed to the spark discharge gap G. Specifically, even when the body base 50 of the ground electrode 5 is disposed at an upstream-side of the flow, with respect to the spark discharge gap G, the flow around the spark discharge gap G is maintained.

It is noted that, a flow of an air fuel mixture hereon is referred to as "flow" and an air fuel ratio referred to as A/F.

Figure 5:
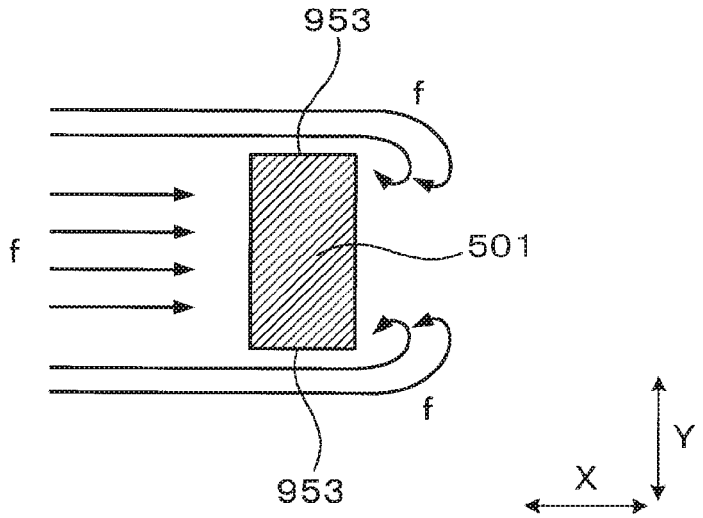
FIG.5 PRIOR ART
FIG. 5 is a descriptive diagram of a flow when a total side-surface of a body base is a flat surface according to a prior art.

When the configuration of the body base 50 is a cross sectional configuration of a conventional spark plug shown in FIG. 5, a flow f flowing to the spark discharge gap G can be easily obstructed, since the spark discharge gap G is positioned at a downstream-side of the body base 501. In this case, a large vortex will occur in the flow f passing across a side-surface 953 of the body base 501 around both ends of the inner surface 51, in the width direction Y as indicated with arrows in FIG. 5. As a result, the flow f passing across the body base 501 will be will be significantly separated there from. A flow rate of the flow f will thus easily lag around the spark discharge gap G, disposed on the downstream side of the body base 501.

Figure 6:
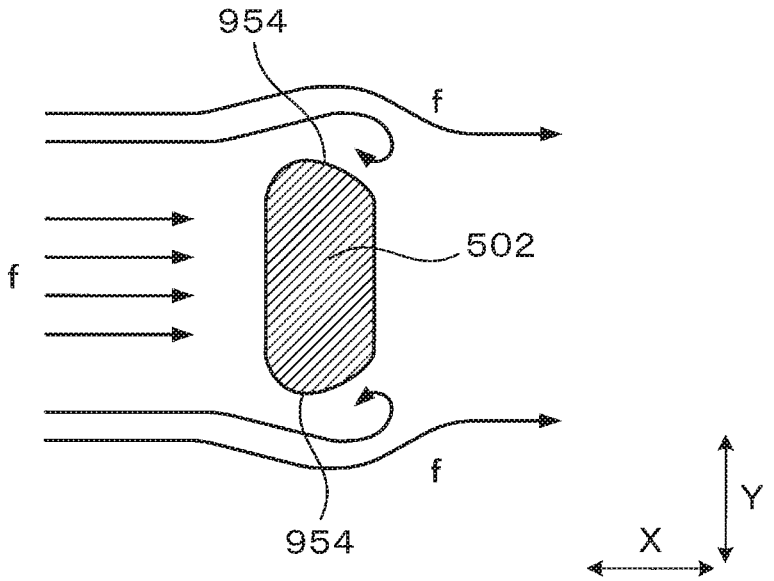
FIG.6 PRIOR ART
FIG. 6 is a descriptive diagram of the flow when the total side-surface of a body base is a curved surface, according to a prior art.

Alternatively, as shown in FIG. 6, if a whole side-surface 954, which is equivalent to the side-connecting surface 53 of the body base 50, is a specific curved surface formation swelled to the outer-side in the width direction Y, it is considered that an occurrence of a vortex is slightly decreased in the flow f passing across the side of the body base 502. However, if the total of the side-surface 954 is a complete curved surface, it becomes difficult to increase a rectification effect to rectify the flow f passing across the side-surface 954 of the body base 502. In which case, it is considered that vortices in the flow f that passes across the side of the body base 502 is not fully preventable.

Figure 7:
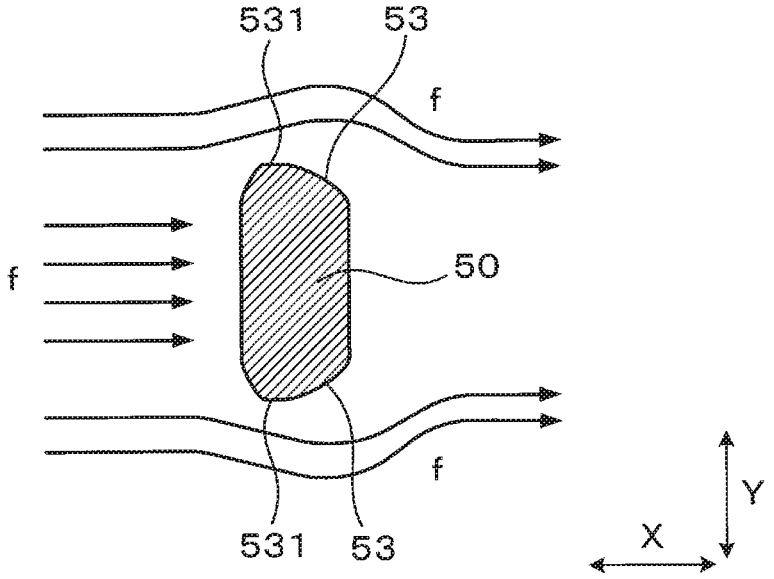
FIG. 7 is a descriptive diagram of the flow when a body base is according to the first embodiment.

In this regard, as shown is FIG. 7, in providing the side flat surface 531, which is the flat surface parallel to the aligning direction X on a portion of the side-connecting surface 53 of the body base 50, and making a dimension of the width direction Y, between the pair of side flat surfaces 531, the maximum width w of the width direction Y, it is considered that an a rectification effect of the flow f passing across the side of the body base can be increased. In other words, since the side-connecting surface 53 is provided with the side flat surface 531, the flow f passing across the side of the body base 50 is considered to be already rectified at the point of passing across the side of the flat surface 531. It is therefore possible to prevent vortices occurring in the flow f flowing across the side-connecting surface 53 of the body base 50. Consequently, the flow rate of the flow f, around the spark discharge gap G, positioned at the downstream-side of the body base, can be easily maintained.

In this way, obstruction of the flow f by the body base 50 can be suppressed not only by simply forming the side surface of the body base as a curved surface, but by also providing a section of the side-connecting surfaces 53 as the side flat surface 531, parallel in the aligning direction X. As the result, a discharged spark is sufficiently drawn out, regardless of the fitted state of the spark plug in the internal combustion engine, in relation to the flow f.

Furthermore, the minimum distance D in the aligning direction X between the inner surface 51 and the side flat surface 531, satisfies a relationship of 0.5 mm≤D≤0.1 mm. The above of which further increases the flow rate of the flow around the spark discharge gap G as a result. Numerical values supporting the above will be described later in experiment examples.

Additionally, the length of the side flat surface 531 in the aligning direction X, which satisfies a relationship of 0.1 mm≤L≤0.5 mm, also increases the flow rate of the flow even more, around the spark discharge gap G. Numerical values supporting the above will also be described later in experimental examples.

The pair of inner-side side-surfaces 532 are smoothly curved surfaces, disposed so that the more inner-side side-surfaces 532 are facing towards the side 4*a* of the center electrode 4 in the aligning direction X, the nearer they become to each other. The flow f flowing across the pair of side-connecting surfaces 53 will therefore be smoothly curved along the inner-side side-surfaces 532 when passing across, and easily directed toward the spark discharge gap G, at the downstream side. Furthermore, the flow rate of the flow around the spark discharge gap G, positioned at the downstream-side of the body base 50, can be maintained.

The pair of side-connecting surfaces 53 are provided with a pair of outer-side side-surfaces 533, disposed there on the side 4*b* of the center electrode 4 of the pair of side flat surfaces 531. The outer-side side-surfaces 533 are formed, so that, the more the outer-side side-surfaces are faced toward the side 4*b* of the center electrode 4 in the aligning direction X, the closer they become to each other. The flow exposed to the outer surface is easily guided to flow from the pair of outer-side side-surfaces 533 to a side of the side-connecting surfaces 53, as a result. Furthermore, the flow rate of the flow flowing along the pair of side-connecting surfaces 53 can be easily secured, which in turn maintains the velocity of the flow around the spark discharge gap G, positioned downstream from the body base 50.

The pair outer-side side-surfaces 533 are smoothly curved to form curved surfaces, so that, the more the outer-side side-surfaces 533 face toward the side 4*a* of the center electrode 4 in the aligning direction X, the nearer they become to each other. Additionally, the previously described effect of maintaining the flow rate along the pair of side-connecting surfaces 53 is obtained more easily. As a result, the flow rate of the flow around the spark discharge gap G, which is positioned downstream from the body base 50, is also easily maintained.

In the preferred embodiment, a spark plug for an internal combustion having a stable ignition performance is obtained, regardless of the fitted state in the internal combustion engine.

Experiment Example 1

Figure 8:
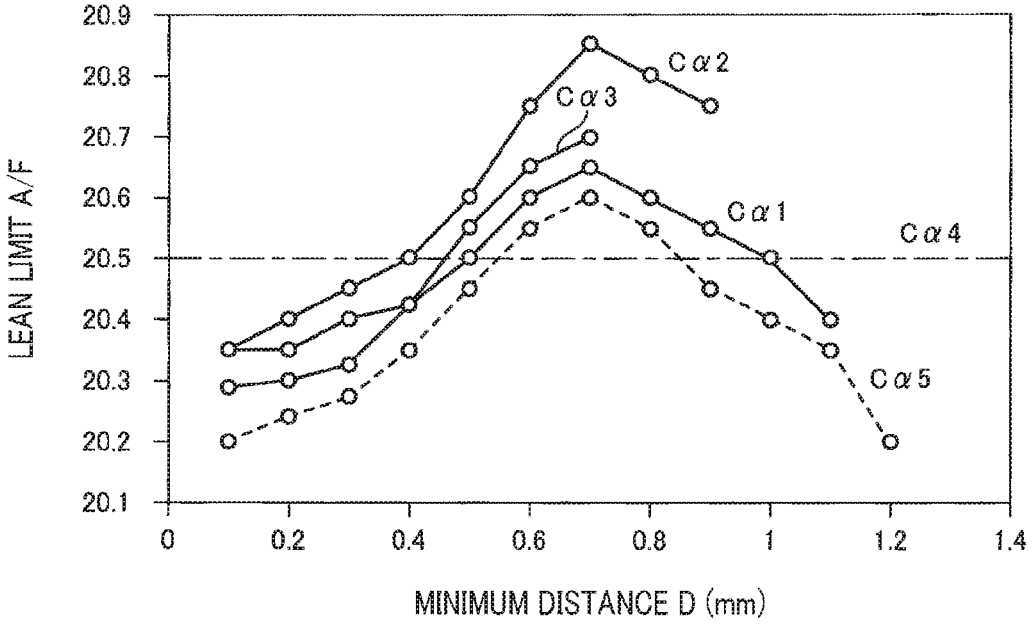
FIG. 8 is a graph showing a relation between a minimum distance and a lean limit A/F ratio according to the first experiment.

In experimental example 1, as shown in FIG. 8, a relation between the minimum distance D of the body base 50 and the ignitability of a spark plug was evaluated.

While a basic structure of the spark plug 1 exemplified in the preferred embodiment is kept, samples having a body base with various changed minimum distances D were prepared and the ignitability of each sample evaluated. It is noted that, the ignitability of each sample was evaluated using a lean limit A/F as an index. More specifically, for each sample mounted in the internal combustion engine, a limiting A/F ratio to actualize the ignitability of each sample was measured by gradually changing an A/F and the lean limiting A/F for ignitability measured.

In the example, a plurality of samples having the minimum distance D changed variously in a range of 0.1 mm to 1.1 mm were constructed. In the example, a plurality of sample groups comprised of the plurality of samples with the changed minimum distance D, and a side flat surfaces 531 of a same length L were prepared. The samples were grouped into a plurality of groups described below. Specifically, samples with a same length L of 0.1 mm having various changed minimum distances D formed sample group α1, samples with a same length L of 0.3 mm having various changed minimum distances D formed sample group α2, and samples with a same length L of 0.5 mm having various changed minimum distances D formed sample group α3.

As shown in FIG. 5, in addition to the above example 1, as a comparative example, a comparative sample α4 was prepared having a total side surface 953 used as a flat surface parallel in the aligning direction X, which is equivalent to the side-connecting surface 53 of the body base 50. As shown in FIG. 6, a second comparative sample group α5 was also prepared, having a total side surface 954 formed as a curved shape, dilated to an outer-side of the width direction Y, which is equivalent to the side-connecting surface 53 of the body base 50. The sample group α5 was a group consisting of a plurality of samples, used as a second comparative example. In the comparative sample group α5, the dimension of the width direction Y, of the body base 502 was variously changed between 0.1 mm to 1 mm, a dimension from a position of a widest point in the width direction Y of the body base to the inner surface 51 in the aligning direction X, is defined as D.

The maximum width w of each body base 50 in the width direction Y, of all the samples was 2.6 mm. The maximum thickness t of each body base 50 in the aligning direction X of all of the samples was 1.3 mm. In the sample groups α1 to α3, a dimension A1 of the outer surface of 52, in the width direction Y of each sample and the comparative sample group α5 was 1.1 mm.

Furthermore, now referring to FIG. 4, a dimension A2 of the inner vertical surface 51, in the width direction Y, was the same as the dimension A1, which was 1.1 mm for each of the samples in sample group α1 to α3, and the comparative sample group α5.

A dimension of the spark discharge gap G was 1.05 mm. The noble metal tip configuring the projection portion 55 of the ground electrode 5 was a columnar shape with a diameter of 0.7 mm and length of 1.0 mm. The noble metal tip configuring the tip end portion 41 of the center electrode 4 was a columnar shape having a diameter of 0.6 mm and a length of 0.8 mm. A diameter of a screw portion of the housing 2 was M12 (12 mm). Additionally, a dimension of a projection, of the main electrode 4 from the housing front end surface was 4.0 mm, in the plug axis direction Z.

In the experiment, each of the samples were mounted in an internal combustion engine, having a position of the body base 50 of the ground electrode 5, arranged at an upstream-side of the flow in relation to the main electrode 4. A four cylinder engine with a displacement of 1800 cc was used as the internal combustion engine in the experiment. Additionally, an engine rotation was 2000 rpm (rotations per minute) and an illustrated brake mean effective pressure was 0.28 MPa. The air fuel ratio having a changing brake mean effective pressure of 3%, is defined as the lean limit A/F. Incidentally, the lean limit air A/F average ratio was an average value of values obtained from 5 experiments performed on each sample.

Results are shown in FIG. 8. In a line graph in FIG. 8, a horizontal axis represents the minimum distance D and a vertical axis represents the lean limit air fuel ratio (A/F). In FIG. 8, the solid lines labelled with Cα1, Cα2 and Cα3 on the line graph show results measured for the respective sample groups: α1, α2 and α3. The dashed line labelled Cα4, represents the lean limit A/F of the comparative sample α4 which was found to be 20.5.

Also in the line graph shown in FIG. 8, the broken line labelled with Cα5 shows a result measured for the comparative sample α5. When evaluating results of the comparative sample α5, in FIG. 8, the horizontal axis is replaced with the minimum distance D, which is equivalent to the dimension.

From the results shown in FIG. 8, it was clarified that the lean limit A/F changes with the minimum distance D in the sample groups α1 to α3. Moreover, from the results, a high lean air fuel ratio was found especially when the minimum distance D of the samples, in groups α1 to α3 was between 0.5 mm to 1.0 mm. That is, the ignitability is increased when the minimum distance satisfies a relationship of 0.5 mm≤D≤1.0 mm.

It was also found that, when the sample groups α1 to α3 were provided with the minimum distance D, within a range of 0.5 mm to 1 mm, the lean limit A/F ratio increased compared with the lean limit A/F ratio of the comparative example α4. From the results, the ignitability of the spark plug is enhanced, when the minimum distance D satisfies a relationship of 0.5 mm≤D≤1.0 mm, compared to a conventional spark plug shown in FIG. 5.

The lean limit A/F ratio was increased in all sample groups α1 to α3, compared to the comparative sample group α5. It was thus found that ignitability is enhanced, by providing the body base 50 with the side flat surface 531, rather than providing a totally curved side surface of the body base 50, whereby a curved surface formation is formed, to an outer-side of the width direction Y.

Experiment Example 2

Figure 9:
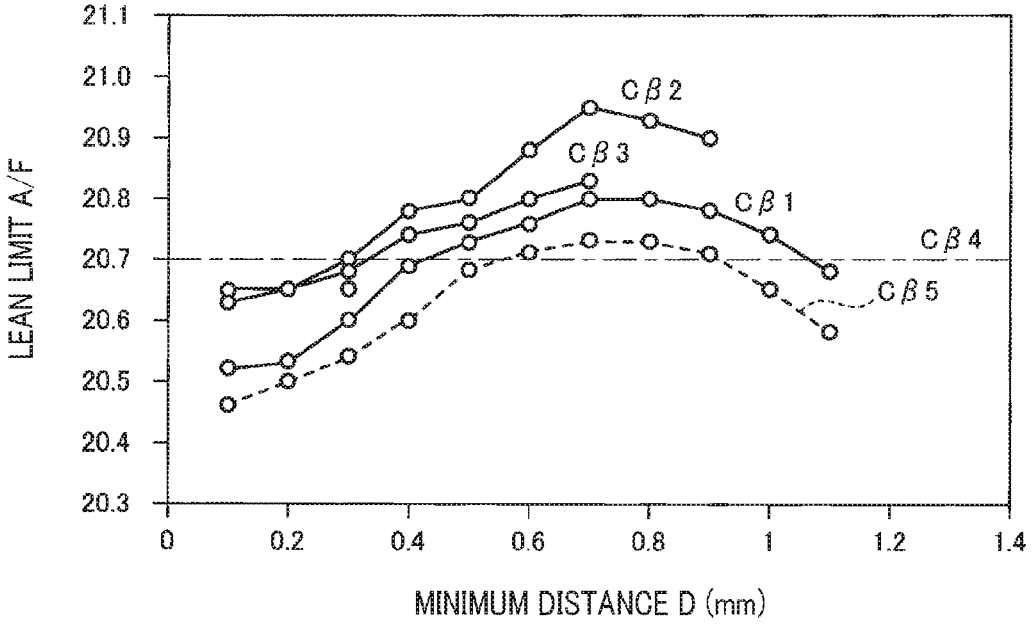
FIG. 9 is a graph showing the relation between the minimum distance and the lean limit A/F ratio according to a second experiment.

As shown in FIG. 9, a same experiment as the experiment example 1 was performed in an experiment example 2, changing the minimum width w, and the dimension A1 and the dimension A2. In experiment example 2, sample groups β1, β2 and β3 were prepared by maintaining the same basic structure of each sample, in the sample groups α1 to α3 of the first experiment, and providing the maximum width of 1.9 mm, the dimension A1 of 0.8 mm and the dimension A2 of 0.8 mm. A comparative sample β4 was also prepared by maintaining a same basic structure as the comparative sample α4 in the first experiment, and providing the maximum width w of 1.9 mm. A second comparative sample β5 was also prepared by maintaining a same basic structure of the comparative sample α5 in the first experiment, and providing the maximum width w of 1.9 mm, a dimension A1 of 0.8 mm and a dimension A2 of 0.8 mm.

The ignitability of each sample was evaluated according to the method described in the experiment example 1. Results are shown in a line graph shown in FIG. 9. The solid lines labelled with Cβ1, Cβ2 and Cβ3 show results measured for the respective sample groups β1, β2 and β3. In a graph shown in FIG. 9, a vertical axis represents the minimum distance D and a horizontal axis represents the lean limiting air fuel ratio (A/F). The dashed line labelled Cβ4, represents the lean limit A/F of comparative sample β4 which was found to be 20.7. Also in the line graph shown in FIG. 9, the broken line labelled with Cβ5 shows a result measured for the comparative sample β5. When evaluating the results from the comparative sample group β5, the horizontal axis is replaced with the minimum distance D, which is equivalent to the dimension.

Furthermore, from the results shown in FIG. 9, it was found that even if the dimension A2 value was changed from conditions described in the experiment example 1, a similar tendency to the results of experiment example 1, shown in FIG. 8, was also obtained in experiment example 2. That is, if the minimum distance D satisfies a relationship of 0.5 mm≤D≤1.0 mm, the ignitability of a spark plug can be increased, regardless of the values of the maximum width w, the dimension A1 and the dimension A2.

Experiment Example 3

Figure 10:
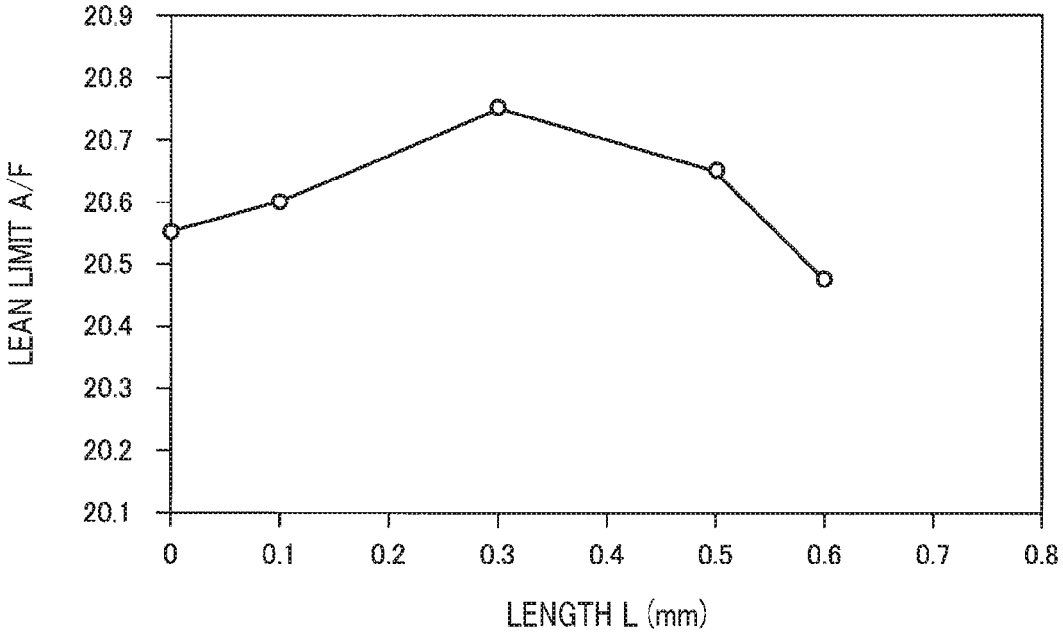
FIG. 10 is a graph showing a relation between a length and a lean limit A/F according to a third experiment.

As shown in FIG. 10, in an experiment example 3, the relation of the length L and ignitability was evaluated.

In the experiment example 3, whilst maintaining the minimum distance D of 0.6 mm, 5 samples were prepared having the length L of 0 mm, 0.1 mm, 0.3 mm, 0.5 mm and 0.6 mm. It is noted that, for the sample having a length L of 0 mm, the dimension from the position of a maximum dimension of the width direction Y, to the inner surface 51 of the body base 50, in the aligning direction X, defined as D, was the same as experiment example 1. Other structural features of the sample were also the same as experiment example 1.

As shown in FIG. 10, evaluation of the ignitability for each sample was performed according to a same method used in experiment example 1.

With further reference to FIG. 10, it was found that a high lean limit air fuel ratio (A/F) was obtained, particularly with samples having the length L in the range of 0.1 mm to 0.5 mm. From the results, it was found that, the length L defined as 0.1 mm≤L≤0.5 mm is desirable from a view point of enhancing ignitability.

Experiment Example 4

Experiment example 4 also evaluates the relation between the length L and ignitability, as described in the experiment example 3, changing the maximum width w, the dimension A1 and the dimension A2. In experiment example 4, whilst maintaining the minimum distance D of 0.6 mm, 5 samples were prepared having the length L of 0 mm, 0.1 mm, 0.3 mm, 0.5 mm, and 0.6 mm. It is noted that, for the sample having a length L of 0 mm, the dimension from the position of the maximum dimension of the width direction Y, to the inner surface 51 of the body base 50, in the aligning direction X, defined as D, was the same as experiment example 2. Other features of the structure for the sample were also the same as experiment example 2.

The ignitability of each sample was evaluated according the same method described in experiment example 1. Results are shown in FIG. 11.

Figure 11:
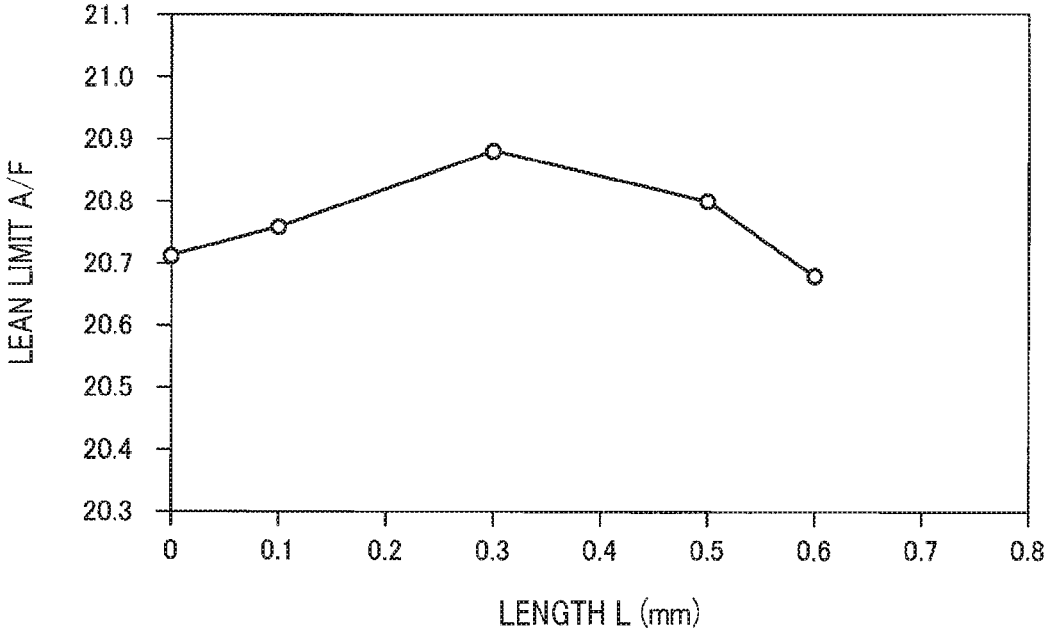
FIG. 11 is a graph showing the relation between the length and the lean limit A/F according to a fourth experiment.

A similar tendency in the results of experiment example 3 (FIG. 10) was also found in the results of experiment example 4, shown in FIG. 11. That is, the ignitability is further improved if the length L satisfies a relationship of 0.1 mm≤L≤0.5 mm, regardless of the maximum width w, the dimension A1 and the dimension A2.

While the present disclosure has been illustrated and described in detail in the drawings and the foregoing description, this should be considered as illustrative and not restrictive in character. It is understood that not only preferred embodiments have been presented, and modifications that come within the spirit of the disclosure are desired to be protected. For example, in the preferred embodiment, a ground electrode provided with a projecting tip portion was exemplified, however, a ground electrode without a projecting tip portion can be incorporated in the spark plug configuration.

REFERENCE SIGN LIST

1 spark plug for an internal combustion engine, 2 housing, 3 ceramic insulator, 4 main electrode, 5 ground electrode, 50 body base, 51 inner surface, 51 outer surface 53 side-connecting surface, 531 side flat surface, D minimum distance.

What is claimed is:

1. A spark plug for an internal combustion engine, the spark plug comprising:

a cylindrical housing having a center axis defined as an axial direction, a plane being perpendicular to the axial direction, an aligning direction and a width direction being defined as mutually orthogonal directions;

a cylindrical porcelain insulator disposed at an inner-side of the cylindrical housing;

a center electrode disposed at an inner-side of the porcelain insulator, such that a front end of the center electrode is projected;

a body base extending from a front end portion of the cylindrical housing to a front end-side; and a ground electrode forming an spark discharge gap therebetween the center electrode; a direction along a line connecting a center of the ground electrode in the width direction and the center axis being defined as the aligning direction;

wherein the body base is provided with;

an inner surface which opposes a side of the center electrode;

an outer surface which opposes an opposite side of the side of the center electrode;

a pair of side-connecting surfaces connecting the inner surface and the outer surface, and a width direction, a pair of the side flat surfaces have a distance therebetween, which is a maximum width of the body base in the width direction, that is orthogonal to both the plug axial direction and the aligning direction, the inner surface and the side flat surfaces are formed to have a minimum distance D between them in the aligning direction which satisfies a relationship of 0.5 mm≤D≤1.0 mm.

2. The spark plug for an internal combustion engine according to claim 1, wherein the side flat surfaces have a length which satisfies a relationship of 0.1 mm≤L≤0.5 mm in the aligning direction.

3. The spark plug for an internal combustion engine according to claim 1, comprising;

a pair of inner-side side-surfaces formed as smoothly curved surfaces, facing towards the side of the center electrode, the pair of inner-side side-surfaces being formed on the pair of the side flat surfaces of the pair of side-connecting surfaces on the side of the center electrode, wherein the more the inner-side-surfaces are facing towards the side of the center electrode in the direction, the nearer the inner-side surfaces become to each other.

4. The spark plug 1 for an internal combustion engine according to claim 1, wherein, the pair of side-connecting surfaces are provided with;

a pair of outer-side side-surfaces facing towards an opposing side of the center electrode side in the aligning direction, the pair of outer-side side-surfaces are formed so that the more the outer-side side-surfaces are facing towards the opposing side of the center electrode side in the aligning direction, the nearer the pair of outer-side side-surfaces become to each other.

5. The spark plug 1 for an internal combustion engine according to claim 4, wherein, the pair of outer-side side-surfaces are smoothly curved to form curved surfaces, the pair of outer-side side-surfaces are formed so that, the more the outer-side side-surfaces are facing towards the opposing side of the side of the center electrode in the aligning direction, the nearer the pair of outer-side side-surfaces become to each other.

6. The spark plug for an internal combustion engine according to claim 2, comprising;

a pair of inner-side side-surfaces formed as smoothly curved surfaces, facing towards the side of the center electrode, the pair of inner-side side-surfaces being formed on the pair of the side flat surfaces of the pair of side-connecting surfaces on the side of the center electrode, wherein the more the inner-side-surfaces are facing towards the side of the center electrode in the direction, the nearer the inner-side surfaces become to each other.

7. The spark plug 1 for an internal combustion engine according to claim 2, wherein, the pair of side-connecting surfaces are provided with;

a pair of outer-side side-surfaces facing towards an opposing side of the center electrode side in the aligning direction, the pair of outer-side side-surfaces are formed so that the more the outer-side side-surfaces are facing towards the opposing side of the center electrode side in the aligning direction, the nearer the pair of outer-side side-surfaces become to each other.

8. The spark plug 1 for an internal combustion engine according to claim 3, wherein, the pair of side-connecting surfaces are provided with;

a pair of outer-side side-surfaces facing towards an opposing side of the center electrode side in the aligning direction, the pair of outer-side side-surfaces are formed so that the more the outer-side side-surfaces are facing towards the opposing side of the center electrode side in the aligning direction, the nearer the pair of outer-side side-surfaces become to each other.

* * * * *